US005115277A

United States Patent [19]

Camis

[11] Patent Number: 5,115,277

[45] Date of Patent: May 19, 1992

[54] ELECTROSTATICALLY ASSISTED TRANSFER ROLLER AND METHOD FOR DIRECTLY TRANSFERRING LIQUID TONER TO A PRINT MEDIUM

[75] Inventor: Thomas Camis, Boise, Id.

[73] Assignee: Hewlett-Packard Company, Palo Alto, Calif.

[21] Appl. No.: 704,572

[22] Filed: May 17, 1991

[51] Int. Cl.[5] ..... G03G 15/16

[52] U.S. Cl. ..... 355/273; 355/279; 355/326; 355/77; 430/126; 430/42

[58] Field of Search ..... 355/271, 273, 274, 279, 355/282, 290, 77, 326, 327; 430/42, 44, 48, 126, 47

[56] References Cited

U.S. PATENT DOCUMENTS

| | | | |
|---|---|---|---|
| 4,602,879 | 7/1986 | Takagi | 430/42 X |
| 5,021,829 | 6/1991 | Johnson et al. | 355/271 X |
| 5,106,056 | 5/1991 | Johnson et al. | 355/279 |

*Primary Examiner*—R. L. Moses

[57] ABSTRACT

An electrostatically assisted transfer roller is rotatably mounted to be driven directly against one surface of an adjacent print media and against an adjacent surface of a photoconductive drum at the other opposite surface of the print media. This transfer roller is operative to transfer transparent developed liquid color toners from the surface of the photoconductive drum and onto the print medium using a combination of mechanical forces, electrostatic forces, and thermal energy. The transfer roller includes a metal inner sleeve member within which a heat source is suitably mounted, and an outer non-metallic sleeve member is positioned around the inner sleeve member and is preferably a conductive silicone or conductive polyurethane material. A thin outer overcoat layer is disposed on the outer surface of the outer sleeve member and is adapted to be driven directly against an adjacent surface of the print medium. A source of DC bias voltage is connected to the metal inner sleeve member to thereby develop electrostatic forces at the surface of the print medium for assisting in the efficient transfer of color images thereon having good print quality.

9 Claims, 7 Drawing Sheets

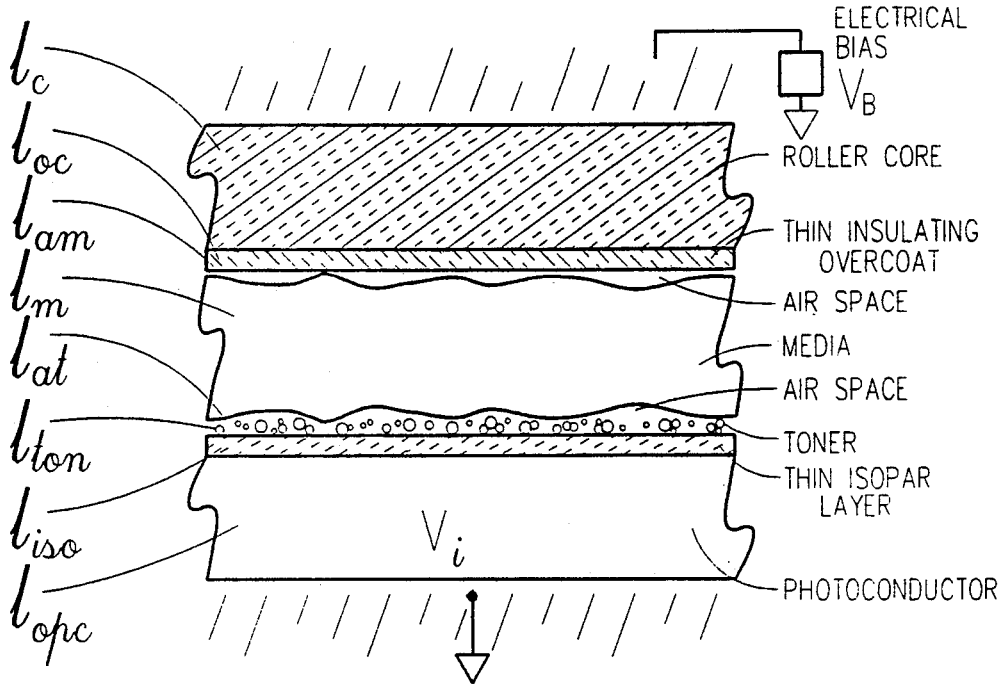

FIG. 2A.

| SYMBOL | LAYER | TYPICAL VALUE | DIELECTRIC CONSTANT |
|---|---|---|---|
| $l_c$ | ROLLER CORE THICKNESS | 5 MILLIMETERS | $k_c \approx 3.0$ |
| $l_{oc}$ | OVERCOAT THICKNESS | 50 MICRONS | $k_{oc} \approx 2.0$ |
| $l_{am}$ | AIR SPACE ABOVE MEDIA | 8 MICRONS | $k_{am} \approx 1.0$ |
| $l_m$ | MEDIA THICKNESS | 100 MICRONS | $k_m \approx 2.5$ |
| $l_{at}$ | AIR SPACE ABOVE TONER LAYER | 8 MICRONS | $k_{at} \approx 1.0$ |
| $l_{ton}$ | TONER LAYER THICKNESS | 2 MICRONS | $k_{ton} \approx 1.5$ |
| $l_{iso}$ | ISOPAR LAYER THICKNESS | 0.2 MICRONS | $k_{iso} \approx 1.99$ |
| $l_{opc}$ | PHOTOCONDUCTOR THICKNESS | 10 MICRONS | $k_{opc} \approx 3.0$ |

NOTE: $l_n/k_n = d_n$ (DIELECTRIC THICKNESS)

FIG. 2B.

$$P_e = \left(\frac{E_{AT} + E_{BT}}{2}\right) \cdot \sigma_{net}$$

WHERE:

$P_e$ = ELECTROSTATIC PRESSURE ACTING ON TONER $E_{AT}$ = ELECTROSTATIC FIELD ABOVE TONER LAYER $E_{BT}$ = ELECTROSTATIC FIELD BELOW TONER LAYER $\sigma_{net}$ = NET TONER CHARGE

CRITICAL FIELD VERSUS FIELD ABOVE TONER LAYER

AIR GAP CRITICAL VOLTAGE vs DIELECTRIC THICKNESS IN SERIES WITH AIR GAP

ELECTROSTATICALLY ASSISTED TRANSFER ROLLER AND METHOD FOR DIRECTLY TRANSFERRING LIQUID TONER TO A PRINT MEDIUM

TECHNICAL FIELD

This invention relates generally to electrophotographic color printing, and more particularly to such color printing which uses transparent liquid toners of various colors such as cyan, yellow, magenta, or black for transferring developed color images directly onto an adjacent print medium.

RELATED APPLICATIONS

In U.S. patent application Ser. No. 07/662,068 of Thomas Camis entitled "Deformable Biased Transfer Roller For An Electrophotographic Printer" filed Feb. 27, 1991, and assigned to the present assignee, there are disclosed and claimed new and useful improvements in the art and technology of electrophotographic printing. These improvements are operative to enhance the print quality of images transferred from a photoconductive drum to an adjacent print media.

In copending U.S. patent application Ser. No. (PD 190,442) of Thomas Camis entitled "Method and Apparatus For Directly Transferring Color Images From A Photoconductive Drum To An Adjacent Print Medium" there are disclosed and claimed further new and useful improvements in the art of electrophotographic printing using color liquid toners and including the direct transfer of color images developed in these toners onto an adjacent print medium. Both of the above identified patent applications are assigned to the present assignee and are incorporated fully herein by reference.

The present invention described herein represents still further new and useful improvements in the art and technology of directly transferring transparent color liquid toners from a photo-conductive drum to an adjacent print medium

BACKGROUND ART

In the field of electrophotographic color printing, one conventional approach to developing a color image on an organic photoconductor and then transferring the developed color image to an adjacent print medium is to use a so-called intermediate transfer member (ITM) which is located between a surface of the organic photoconductive drum and the surface of the print medium. Using this approach, liquid toners of cyan, yellow, magenta, or black are first transferred electrostatically in series from a conventional source of liquid toners to the surface of the organic photoconductor and then serially developed thereon such as by writing the desired color image with a controlled laser beam or other suitable light source. Color liquid toners are generally well known in the art of electrophotographic printing and are described in some detail, for example, in U.S. Pat. Nos. 4,925,766 and 4,946,753 issued to Elmasry et al and entitled "Liquid Electrophotographic Toners", both incorporated herein by reference.

When each color of cyan, yellow, magenta, or black has been individually developed on the organic photoconductive drum, the intermediate transfer member is then brought into intimate contact with the surface of the drum and is rotated against the drum to thereby serially transfer each color image from the surface of the photoconductive drum to the intermediate transfer member. Since the color toners used in this process could not be directly transferred to the media, each color toner had to be first developed on the photoconductive drum and then stored on the intermediate transfer member where subsequently developed color images would be superimposed one upon the other. When all of the cyan, magenta, yellow, and black toner images were formed on the intermediate transfer member, the print media was brought into intimate contact with the intermediate transfer member for transferring the composite developed color image thereto using a combination of heat and mechanical pressure supplied by conventional transfer roller techniques. One example of using an intermediate transfer member (ITM) for transferring the color image from the photoconductive drum to the print media is disclosed in U.S. Pat. No. 4,286,039 issued to Landa et al. and incorporated herein by reference. In addition, an ITM color printer of the type generally described above has also been described by the 3-M Company of Minneapolis, Minn. and has been labeled as their "Digital Matchprint or Digital Writer", but the constructional details of this color printer are not currently known.

The use of the above described intermediate transfer member has been required in the above prior art electrophotographic color printing apparatus because of the fact that intimate contact between the toner and the receiving surface was essential for high quality transfer of the developed image from the surface of the photoconductive drum. The requirement for the use of this intermediate transfer member had the effect of adding production cost and maintenance expense to these color printers and required critical transfer alignments and relative movements between the intermediate transfer member and the photoconductive drum in order to provide an acceptable print quality on the printed media.

Subsequently, when transparent color toners were being developed, proposals were made to eliminate the above intermediate transfer member and develop the color images directly on top of one another on the surface of the photoconductive drum. However, earlier attempts to transfer developed transparent color images directly from the surface of the photoconductive drum to the print media failed because there were not sufficient transfer forces and/or good intimate contact made between the developed color images on the drum and the relatively rough surface of the print media as a result of the conventional heat and pressure transfer roller techniques utilized. It is the solution to this latter problem to which the present invention is directed.

DISCLOSURE OF INVENTION

The general purpose and principal object of the present invention is to provide a new and improved electrophotographic color printing apparatus which is operative to transfer the developed transparent color toners and color images directly from the surface of a photoconductive drum to an adjacent print medium without going through an intermediate transfer step such as that described above using an intermediate transfer member positioned between the drum and the print medium.

Another object of this invention is to provide a new and improved electrophotographic color printing apparatus of the type described which is operative to eliminate the cost and complexity and reliability and print quality problems brought about by the above prior art requirement for using this intermediate transfer member.

Another object of this invention is to reduce the size required for the print engine.

To accomplish the above purpose and objects while simultaneously achieving many other advantages related thereto and described below, there is disclosed and claimed herein a direct transfer roller apparatus for directly and effectively transferring transparent liquid color toners and developed color images therein from the surface of a photoconductive drum to an adjacent print medium at a high degree of print quality. The novel direct transfer roller apparatus of the present invention is operatively mounted on the side of the print medium opposite to that of the photoconductive drum and is driven in intimate contact against one surface of the print medium as the surface of the photoconductive drum is driven in intimate contact with the opposite surface of the print medium.

This direct transfer roller apparatus includes a metal inner sleeve core member within which a heat source is suitably mounted. An outer non-metallic sleeve member is positioned to surround the inner sleeve core member and is preferably either a conductive silicone or a conductive polyurethane material typically on the order of five (5) millimeters in thickness. A thin outer dielectric overcoat layer is formed on the outer surface of the outer sleeve member, and in operation, this outer overcoat layer is operatively driven in direct intimate contact with the print media which passes between this thin overcoat layer and an adjacent surface of a photoconductive drum upon which color images have been developed. The inner metal sleeve member of the transfer roller is operatively connected to a source of DC bias voltage, so that the transfer roller operates to apply a combination of thermal energy, electrostatic forces and mechanical pressure to the print media, and in an optimum combination of these three parameters. This operation is useful in providing good and complete transfer of all of the developed transparent toners color images from the surface of the photoconductive drum directly onto the adjacent print media without the use of any intermediate transfer member.

The novel method carried out in accordance with the present invention includes the steps of driving a transfer roller against the surface of a print medium, and applying a combination of electrostatic forces, mechanical forces, and thermal energy to a nip zone at which a liquid toner is being transferred to the print medium. The electrostatic pressure, $P_e$, applied to the liquid toner is defined by the following expression: $P_e=[(E_{AT}+E_{BT})/2]\cdot\sigma_{net}$, where $E_{AT}$ is the electrostatic field above the toner layer, $E_{BT}$ is the electrostatic field below the toner layer, and $\sigma_{net}$ is the net electrical charge on the toner layer being transferred.

The above brief summary of the invention, taken together with its various objects and associated advantages, will become better understood with reference to the following description of the accompanying drawing.

BRIEF DESCRIPTION OF THE DRAWINGS

FIG. 2A is an enlarged cross sectional view showing the various layers of material for the electrostatically assisted transfer roller apparatus in accordance with the present invention. These layers also include the print media and adjacent photoconductive drum.

FIG. 2B is a table of some typical layer values and thicknesses for the cross section view of FIG. 2A.

FIG. 3 is presented herewith to illustrate the need for the electrostatic assistance techniques made available by the present invention.

DESCRIPTION OF THE PREFERRED EMBODIMENT

Figure 1:
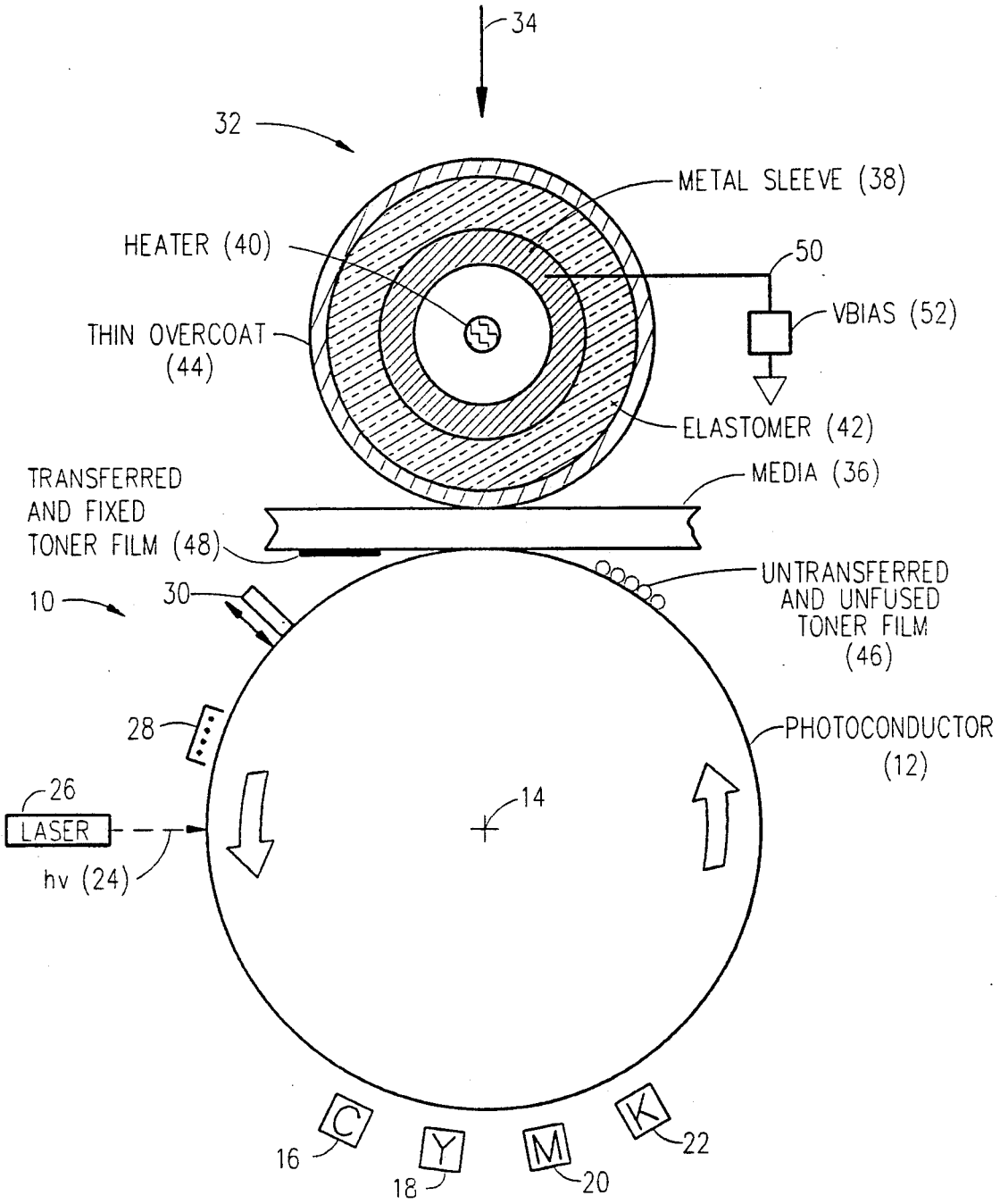
FIG. 1 is an abbreviated schematic cross sectional view of an electrophotographic printer apparatus in which the present invention is used.

Referring now to FIG. 1, the electrophotographic printer apparatus shown therein is designated generally as 10 and it includes an organic photoconductive drum 12 which is operative to rotate counterclockwise as shown about a central axis of rotation 14. A plurality of color and black liquid toner sources 16, 18, 20, and 22 are positioned as shown adjacent to a lower surface of the photoconductive drum 12, and these cyan, yellow, magenta, or black sources of liquid toner are operated in a conventional manner to transfer the liquid toners in series to the surface of the photoconductive drum 12 once each 360° rotation of the photoconductive drum 12. The cyan, yellow, magenta, or black color planes of the color image are developed, one after another, by writing with a conventional light beam 24 from a source 26 of monochromatic light.

The electrophotographic printing apparatus 10 will also typically include a corona discharge element 28 and a cleaning member 30, both positioned as shown adjacent to the surface of the photoconductive drum 12. The cleaning member 30 is periodically cammed as is well known during the removal of toner particles from the surface of the photoconductive drum 12. The photoconductive drum 12 will typically be an aluminum based drum with a photoconductive material thereon consisting of a ten (10) micrometer charge transport layer of typically a hydrazone material and 0.4 micrometers of a charge generation layer including a Bisazo pigment.

After the cyan, yellow, magenta, and black color planes of the image have all been developed on the surface of the photoconductive drum 12, the electrostatically assisted transfer roller designated generally as 32 is moved in the direction of the arrow 34 so as to drive the print media 36 into direct contact with the rotating surface of the photoconductive drum 12.

The electrostatically assisted transfer roller 32 includes a metal inner sleeve member 38 such as aluminum having a controllable heat source 40 such as an elongated quartz tube or bulb suitably mounted therein. An outer sleeve member 42 is positioned to surround the inner sleeve member 38, and the outer sleeve member 42 is preferably made of a conductive silicone or conductive polyurethane material. A thin outer overcoat film 44 such as 25–50 micrometers of Teflon TM is disposed on the outer surface of the outer sleeve member 42 and is adapted for directly driving against the adjacent print media 36.

The electrostatically assisted transfer roller apparatus 32 utilizes a combination of mechanical pressure, electrostatic forces, and thermal energy to transfer an unfused toner film 46 to the undersurface of the print media 36 where it becomes a fixed toner film as indicated at 48. The inner metal sleeve 38 is connected by way of a conductor 50 to a DC supply voltage 52 which produces the electrostatic field for the transfer roller 32. As indicated above, the transfer roller 32 is designed to efficiently conduct heat to the media 36 via the centrally disposed heat source 40. The electrostatic pressure acting on the toner film 46 will be typically in the order of 0.1 psi–0.2 psi, and it will be shown below that the electrostatic "pulling" of the toner film 46 toward the print media 36 is directly related to the strength of the average electrostatic fields above and below the toner layer 46 as well as the net electrical charge of the toner. This electrostatic "negative" pressure coupled with the film forming tendencies of the toner under an additional combination of heat and mechanical pressures is the key to efficiently transferring the toner films 46 to the media 36 without any significant loss of image quality or character fidelity.

Referring now to the multi-layer cross section view shown in FIG. 2A, together with the corresponding table of values shown in FIG. 2B, this illustration is designed to highlight the problem brought about when the contour 54 of the surface of the print media 36 is sufficiently rough so that it produces air gaps 56 above the toner layer 46 which are formed above a thin isopar layer 58 on the surface of the photoconductive drum 12. These air gaps 56 make it impossible under conditions of heat and pressure alone to cause all of the developed areas of the unfused toner layer 46 to be transferred to the lower surface 54 of the print media 36.

Figure 3:
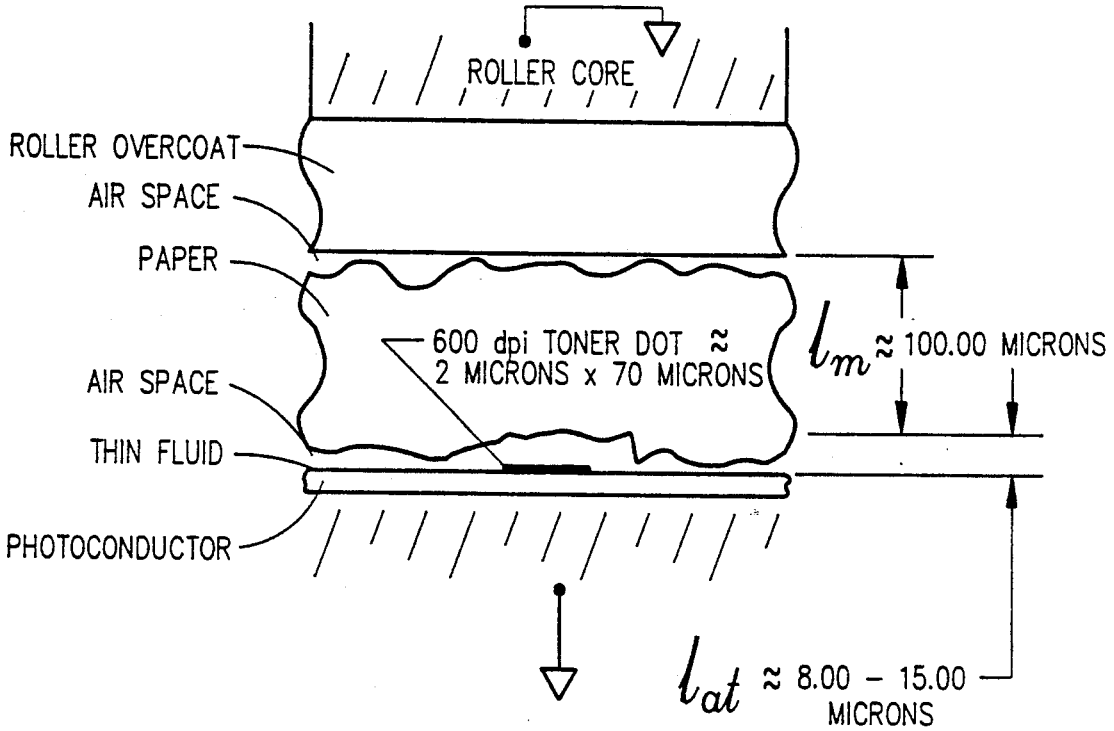
FIG. 3 is a greatly enlarged cross sectional view showing the contour of the edges of the print media (paper) in relation to a typical high resolution dot of toner which is to be transferred from the photoconductor surface to the surface of the paper.

Referring now FIG. 3, the illustration of this problem is again greatly enlarged where typically in a 600 dots per inch (dpi) electrostatic printer, the toner dot 60 may typically be 2 microns thick by 70 microns in diameter. In this illustration, the rough contour 54 of the media 36 shown can be almost completely removed from any direct physical contact at all to the undersurface of the 100 micron thick media layer 36. However, in accordance with the present invention, the electrostatic field produced in the transfer roller 32 is operative in combination with heat and the mechanical pressures exerted by the transfer roller 32 to ensure that substantially all of the 600 dpi toner dots 60 are pulled onto the undersurface of the paper 36 in the manner described further below.

The electrostatic pressure, $P_e$, acting on the toner layer in the nip zone may be defined according to Equation 1 below which originates from Maxwell's Stress Equation and the definition of electrostatic pressure which is well known in electrostatic field theory.

$$P_e=[(E_{AT}+E_{BT})/2]\cdot\sigma_{net} \quad (1)$$

where $E_{AT}$ is equal to the electrostatic field above the toner layer, $E_{BT}$ is equal to the electrostatic field below the toner layer, and $\sigma_{net}$ is equal to the net electrical charge on the toner. The electrostatic field, $E_{AT}$, above the toner layer is a time dependent function that will vary due to paper volume resistivity and the transfer nip or contact zone dwell time. The electrostatic field, $E_{BT}$, below the toner layer is in the thin fluid (isopar) layer region at the surface of the photoconductive drum 12 and is given by Equation 2 as follows:

$$E_{BT}=1/k_{iso}\cdot[\sigma_{net}\epsilon_o+E_{AT}] \quad (2)$$

where $k_{iso}$ is equal to the dielectric constant of the isopar fluid layer below the toner, $\sigma_{net}$ is equal to the net electrical charge on the toner, $\epsilon_o$ is equal to the permitivity of free space, and $E_{AT}$ is equal to the time dependent electrostatic field in the air space just above the toner layer. Thus, the electrostatic pressure acting on the charged toner layer can now be simplified into the following expression:

$$P_e=[E_{AT}(k_{iso}+1)/2k_{iso}+\sigma_{net}/2k_{iso}\cdot\epsilon_o]\cdot\sigma_{net} \quad (3)$$

It should also be noted that with a positive electrical charge on the toner and a negative electrical bias applied to the transfer roller 32, the electrostatic field $E_{AT}$ above the toner layer will be a negative function by convention. The toner on the other hand will be of a positive polarity, so that the minimum requirement or threshold condition for the necessary "negative" transfer pressure will be when the following condition is achieved using absolute values $$E_{AT}[k_{iso}+1]/k_{iso}\geqq\sigma_{net}/k_{iso}\cdot\epsilon_o \quad (4)$$

Therefore, the threshold level for the absolute minimum value of $E_{AT}$ necessary to electrostatically pull the developed unfused liquid toner from the photoconductive drum 12 onto the print media 36 is when the following expression obtains:

$$|E_{AT}|=\sigma_{net}/\epsilon_o\cdot[k_{iso}+1] \quad (5)$$

The above condition given in Equation 5 ensures that the electrostatic detachment field pulling on the toner will be greater than the counter field which is in the opposite direction and serves to sufficiently attract the toner to the surface of the photoconductive drum. In addition, the electrostatic pressure equations given above suggest that the optimum electrostatic transfer pressures can be achieved by a careful selection of both the toner charge per unit mass and the toner layer thickness.

Figure 4:
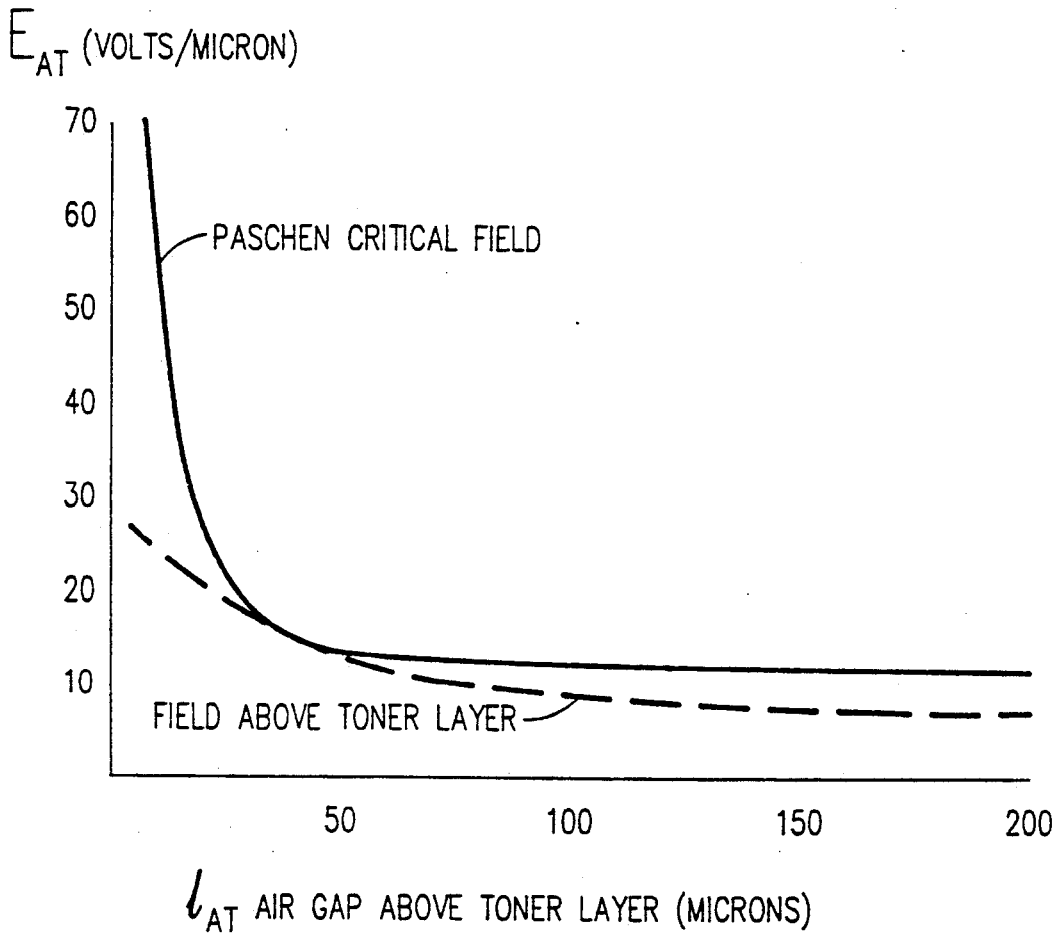
FIG. 4 is a graph which plots the Paschen critical field in relationship to the field above the toner layer for a given set of conditions. Both of these fields given in volts per micron are plotted as a function of the air gap distance above the toner layer.

The critical electrostatic field allowed in the air space between the media 36 and the toner layer 46 at atmospheric pressure is described as follows by the familiar Paschen equation for short air gaps between 5 microns and 100:

$$E_{critical}=6.2\ volts+312\ volts/l_{at} \quad (6)$$

where $l_{at}$ is equal to the air space above the toner layer 46. The electrostatic field $E_{AT}$ in the air space just above the toner layer is also shown in FIG. 4 of the drawings, and this graph or plot in FIG. 4 shows the maximum field that can be tolerated just above the toner layer without producing air ionization which would otherwise cause disruptive toner scattering and image degradation. The electrostatic field shown in FIG. 4 above the toner layer was accomplished using a maximum allowable bias voltage of −981 volts applied to the transfer roller inner sleeve member 38 and using a transfer nip dwell time of 200 milliseconds and a paper bulk resistivity of $10^9$ ohm·centimeters. During this transfer of the image from the photoconductive drum to the print media, the quartz tube 40 should be heated to a controlled elevated temperature sufficient to raise the temperature of the media to a range of 70°-80° C. Simultaneously, the mechanical pressure in the nip zone should be on the order of five (5) psi or greater. This combination of values ensured that the critical Paschen threshold field in the air space above the toner was not exceeded, and otherwise resulting in disruptive air ionization, image degradation and a loss of electrostatic transfer pressure acting on the toner.

Figure 5:
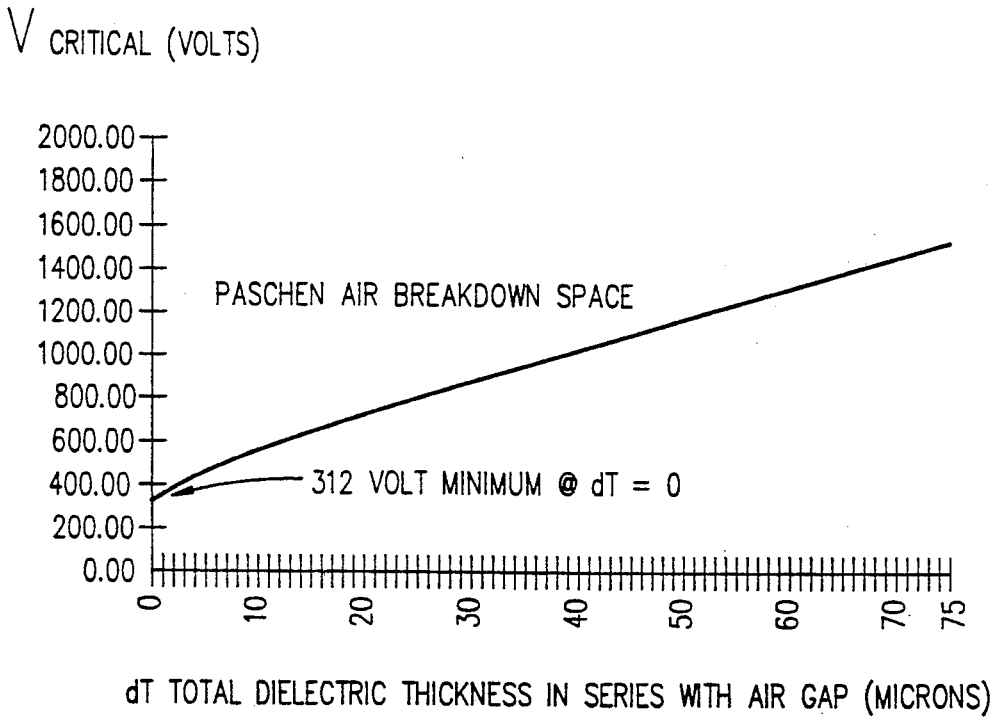
FIG. 5 is a plot of the air gap critical voltage that is allowed between the toner and paper versus the total dielectric layer thickness in series with the air gap between toner and paper.

Referring now to FIG. 5, the maximum allowable voltage across the air gap above the toner is plotted in this figure as a function of the total dielectric thickness in series with the air space above the toner. In this example, the sum of the dielectric thicknesses above the toner was approximately 37.8 microns, and this value in turn resulted in a critical voltage of 1086.7 volts within the air gap above the toner layer.

Figure 6:
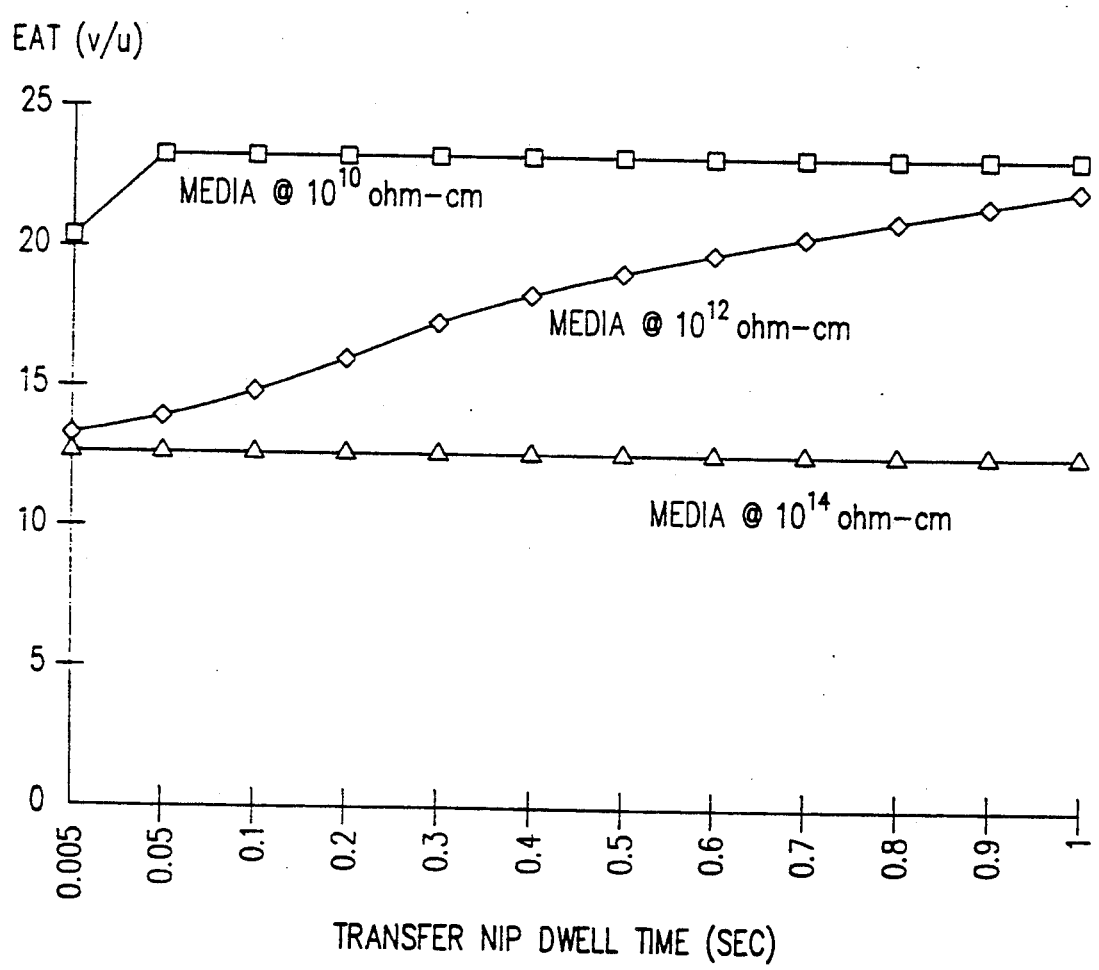
FIG. 6 is a graph which plots the electrostatic transfer field acting on the toner in the nip contact zone as a function of transfer nip dwell time in seconds for papers having three separate bulk resistivities in ohm-centimeters.

Referring now to FIG. 6, there are shown some typical values for the electrostatic fields $E_{AT}$ in volts per micron acting on the toner in the intimate contact or nip zone between the media 36 and the transfer roller 32. The transfer fields in FIG. 6 can be expected to vary from a minimum of about 12.7 volts per micron using high resistivity media to a maximum of about 22.5 volts per micron for the more conductive media.

Figure 7:
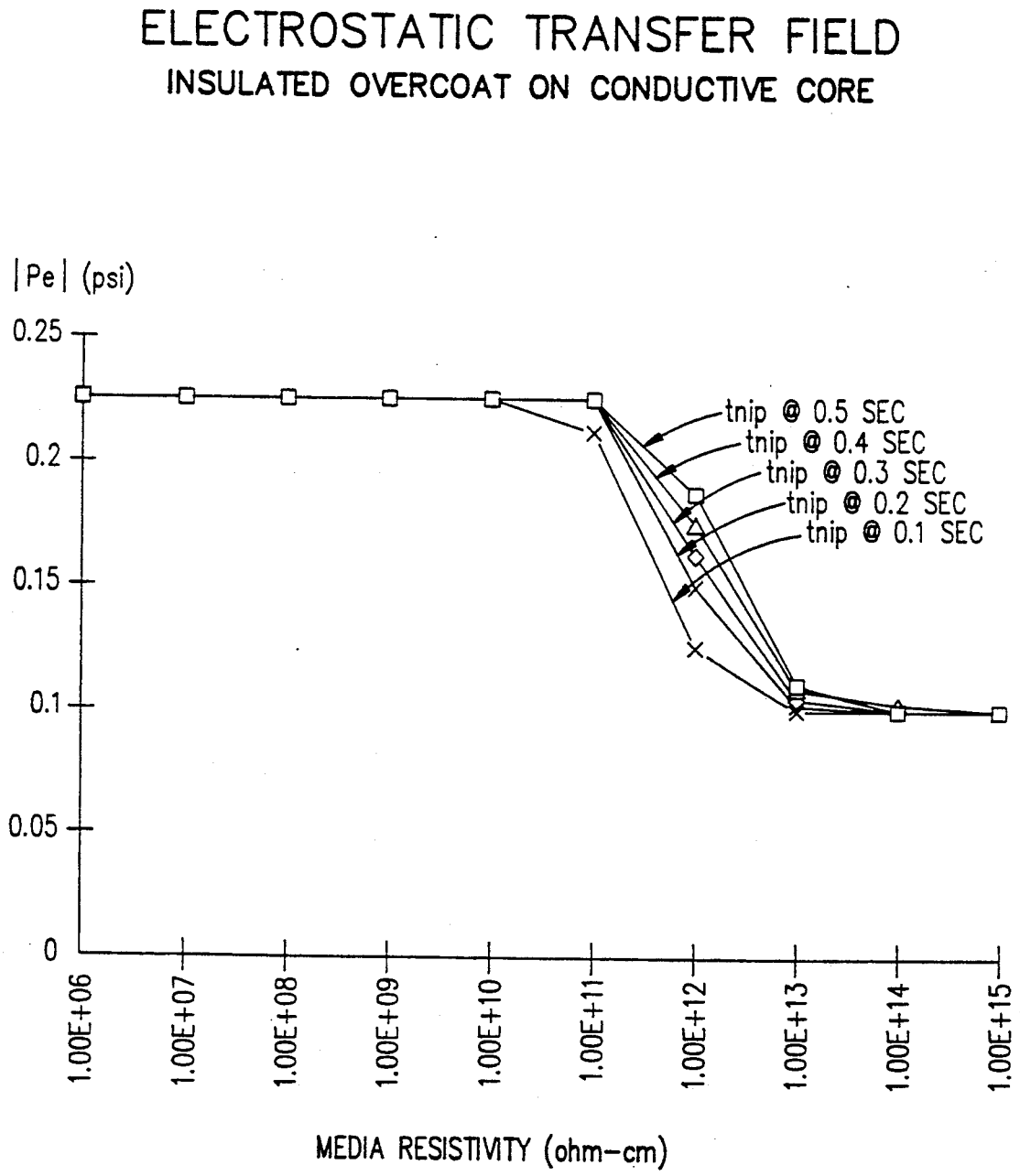
FIG. 7 is a graph which plots the absolute electrostatic pressure, $P_e$, acting on the toner as a function of variations in media resistivity for five different nip dwell times as indicated. These values were determined using optimum conditions.

Referring now to FIG. 7, there are shown the resultant electrostatic transfer pressures, $P_e$ in psi, acting on the toner as a function of media resistivity in ohm·centimeters and transfer nip contact dwell times in seconds.

Various modifications may be made in and to the above described embodiment without departing from the spirit and scope of this invention. Accordingly, such modifications and changes in materials used as well as variations in electrostatic forces, mechanical pressures and thermal energy used are all clearly within the scope of the following appended claims.

I claim:

1. An electrostatically assisted transfer roller apparatus for directly transferring liquid toners to a print medium including, in combination:

a. a metal inner sleeve member having a controllable heat source suitably mounted therein, b. a non-metallic outer sleeve member positioned to surround said inner sleeve member, c. means connecting said inner metal sleeve member to a source of DC bias potential, whereby said transfer roller is operative to simultaneously apply a combination of mechanical pressure, thermal energy and electrostatic forces to one surface of said print media to thereby efficiently pull developed toners from the surface of a photoconductive drum driven against the opposite surface of said print media.

2. The apparatus defined in claim 1 which further includes an outer overcoat film disposed on the outer surface of said outer sleeve member and adapted for directly driving an adjacent print medium.

3. The apparatus defined in claim 1 wherein said metal inner sleeve member is aluminum and said non-metallic outer sleeve member is selected from the group consisting of conductive silicone and conductive polyurethane.

4. The apparatus defined in claim 1 wherein said non-metallic outer sleeve has a thin overcoating thereon of a chosen polyurethane material.

5. A method for efficiently transferring toners from a surface of a photoconductive drum onto one surface of a print medium which includes the steps of:

a. driving a transfer roller against an opposite surface of said print medium in the region where a toner layer is to be transferred, while simultaneously b. applying a combination of pressures from said transfer roller to said opposite surface of said print medium, said pressures from said transfer roller being a combination of electrostatic forces, mechanical forces and thermal energy applied to said print medium.

6. The method defined in claim 5 wherein an electrostatic pressure, $P_e$, applied to the toner is defined by the following expression:

$$P_e=[(E_{AT}+E_{BT})/2]\cdot\sigma_{net},$$

where $E_{AT}$ is the electrostatic field above the toner layer, $E_{BT}$ is the electrostatic field below the toner layer, and $\sigma_{net}$ is the net electrical charge on the toner layer being transferred.

7. A method of transferring a color image to a print media which comprises the steps of:

a. developing transparent toners one on top of another on the surface of a photoconductive drum, and b. utilizing a combination of heat, mechanical forces, and electrostatic forces to transfer said developed toners onto said print media.

8. The method defined in claim 7 which includes developing an electrostatic pressure, $P_e$, on the toners on the surface of said photoconductive drum which is equal to $$P_e=[(E_{AT}+E_{BT})/2]\cdot\sigma_{net},$$

where $E_{AT}$ is the electrostatic field above the toner layer, $E_{BT}$ is the electrostatic field below the toner layer, and $\sigma_{net}$ is the net electrical charge on the toner layer being transferred.

9. The method defined in claim 8 wherein said electrostatic pressure is created by applying a predetermined DC voltage to a transfer roller which is positioned on the opposite side of said media from said photoconductive drum.

* * * * *